US008672032B2

(12) United States Patent
Bobier et al.

(10) Patent No.: US 8,672,032 B2
(45) Date of Patent: Mar. 18, 2014

(54) SPLIT STREAM OILFIELD PUMPING SYSTEM UTILIZING RECYCLED, HIGH REID VAPOR PRESSURE FLUID

(75) Inventors: Dwight M. Bobier, Calgary (CA); Donald Robert Battenfelder, Cochrane (CA); Leslie M. Wise, Calgary (CA)

(73) Assignee: Calfrac Well Services Ltd., Calgary, Alberta (CA)

( * ) Notice: Subject to any disclaimer, the term of this patent is extended or adjusted under 35 U.S.C. 154(b) by 290 days.

(21) Appl. No.: 12/801,820

(22) Filed: Jun. 28, 2010

(65) Prior Publication Data

US 2010/0326663 A1 Dec. 30, 2010

(51) Int. Cl.
*E21B 43/26* (2006.01)

(52) U.S. Cl.
USPC ..... 166/308.1; 166/305.1; 166/177.5; 166/307; 166/75.11; 166/91.1

(58) Field of Classification Search
USPC ..... 166/305.1, 308.1, 177.5
See application file for complete search history.

(56) References Cited

U.S. PATENT DOCUMENTS

| | | | | |
|---|---|---|---|---|
| 5,133,624 | A * | 7/1992 | Cahill | 405/129.4 |
| 7,451,820 | B2 * | 11/2008 | Albers et al. | 166/308.6 |
| 2003/0161212 | A1 * | 8/2003 | Neal et al. | 366/10 |
| 2007/0277982 | A1 | 12/2007 | Shampine et al. | |
| 2010/0032031 | A1 * | 2/2010 | Neal | 137/565.01 |

* cited by examiner

*Primary Examiner* — Shane Bomar
*Assistant Examiner* — Silvana Runyan
(74) *Attorney, Agent, or Firm* — Welsh Flaxman & Gitler LLC

(57) ABSTRACT

A split stream oilfield pumping system is provided which utilizes recycled high Reid vapor pressure production fluids. The oilfield system is made up of two separate fluid streams: a first recycled fluid stream and a second new fluid stream. The recycled fluid stream is enclosed to reduce or eliminate vaporization of the recycled fluid, which typically will have a Reid vapor pressure >14 kPa. Wellbore treatment additives are added to the new fluid stream, and the resultant treatment fluid is mixed with the recycled fluid in a common manifold to provide a final wellbore treatment fluid to be delivered to the wellhead.

19 Claims, 1 Drawing Sheet

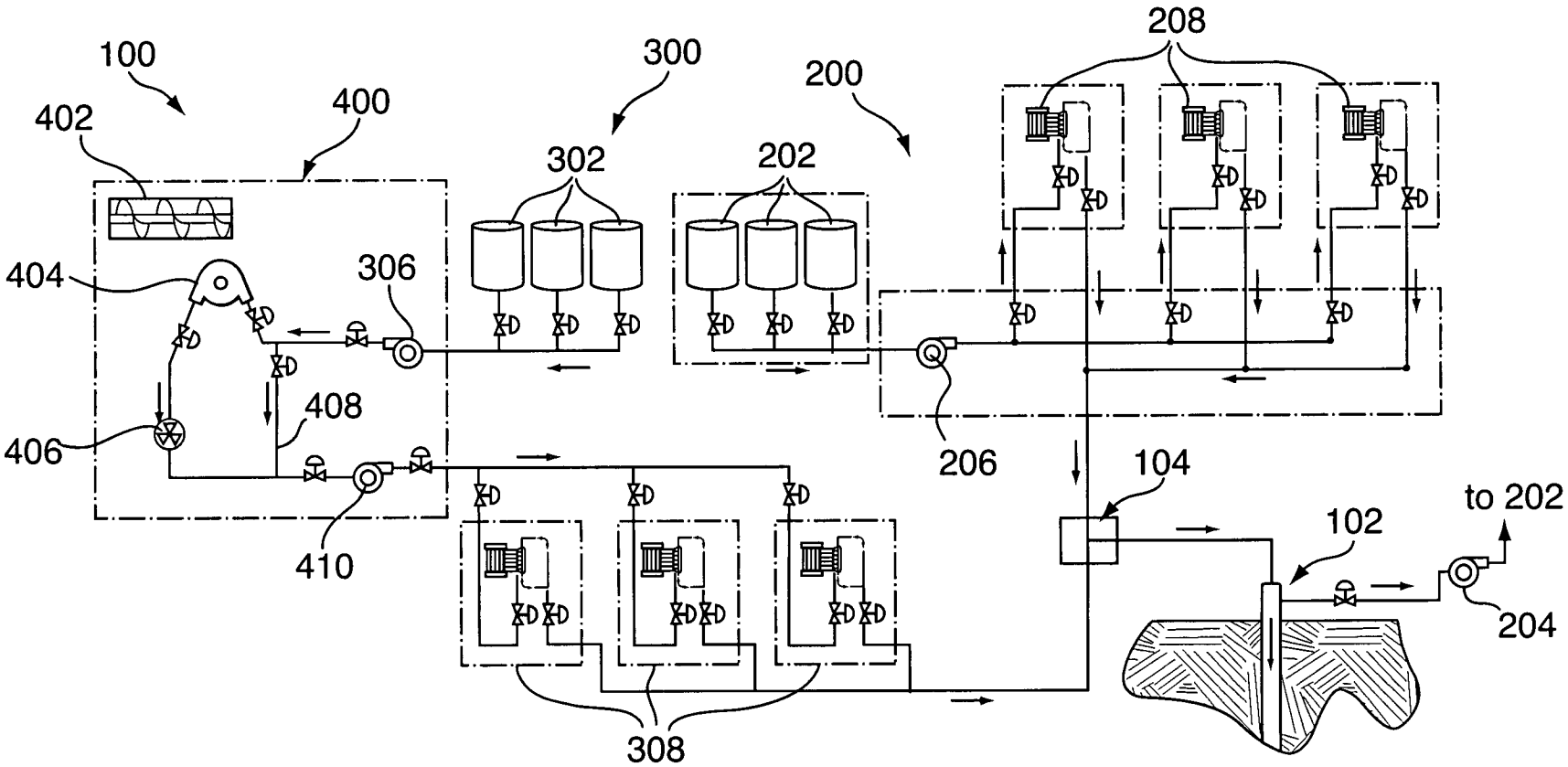
to 202
204
102
208
104
206
200
202
300
302
308
306
400
408
410
100
402
404
406

SPLIT STREAM OILFIELD PUMPING SYSTEM UTILIZING RECYCLED, HIGH REID VAPOR PRESSURE FLUID

FIELD OF THE INVENTION

This invention relates to oilfield pumping operations and more particularly to the pumping of dual fluid streams into a wellbore, one of the fluid streams comprising new or recycled fluids having a high Reid Vapor Pressure.

BACKGROUND OF THE INVENTION

In certain oilfield applications, pump assemblies are used to pump a treatment fluid from the surface down a wellbore, often at extremely high pressures. Such applications include but are not limited to hydraulic fracturing, cementing, acidizing, and pumping through coiled tubing, among other applications. In the example of hydraulic fracturing operations, a multi-pump assembly is often employed to direct a fracturing fluid into the wellbore and to a selected region(s) of the wellbore. The configuration of the well bore can vary and is subject to the type of completion most effective for the particular situation. The fracturing fluid is pumped from the wellbore into the formation to create "fractures" connecting the native reservoir to the wellbore that intersects the reservoir or the fracture network. To create such fractures, the fracturing fluid is pumped at pressures ranging from 1,000 to 15,000 psi or more. The mass flow rate of the fracturing fluid will vary depending upon what is required for the wellbore conditions. In addition, the fracturing fluid may or may not contain a propping agent, hereinafter called "proppant". The proppant is used to keep the fracture "propped" open after the creation of the fracture as well as aiding in other fracturing mechanisms. These fractures provide communication pathways to the reservoir and allow formation deposits to flow into the wellbore and to the surface of the well. These additional pathways serve therefore to enhance the production of the well.

A power pump is typically employed for conveying the fracturing fluid into the wellbore during fracturing operations. A power pump is a positive displacement pump consisting of one or more cylinders each containing a piston or plunger. Such pumps are sometimes also referred to as positive displacement pumps, intermittent duty pumps, triplex pumps, or quintuplex pumps. This style of pump translates rotating motion to a linear actuation by means of a crankshaft—slider mechanism. The plunger is moved in two directions along a single axis. This motion moves the plunger in and out of a chamber in a pressure housing (typically referred to as a fluid end) in order to change the fluid volume of the chamber. Fluid enters the chamber through a one way valve as the plunger is sliding out of the chamber and the chamber volume increases. As the plunger slides into the chamber and decreases chamber volume, the fluid is displaced out of the chamber through a one way valve. This pumping action occurs in each of the fluid chambers of the fluid end and the summation of the individual compartments combines for a total output flow from the fluid end.

Multiple pumps are often employed simultaneously in large scale hydraulic fracturing operations. These pumps may be linked to one another through a common manifold, which mechanically collects and distributes the combined output of the individual pumps. For example, hydraulic fracturing operations often proceed in this manner with perhaps as many as twenty plunger pumps or more coupled together through a common manifold. A centralized computer system may be employed to direct the entire system for the duration of the operation.

However, the abrasive nature of fracturing fluids caused by the presence of proppant tends to wear out the internal components of the plunger pumps and associated piping components that are used to pump it. The repair, replacement and/or maintenance expenses for the internal components are extremely high, and the overall life expectancy is low for components used to convey fracturing fluids to the well bore.

To combat this state of affairs, pumping systems have been developed wherein a "dirty" stream of fracturing fluid (containing the abrasive proppant) and a "clean" stream of fracturing fluid (without proppant) is mixed in a common manifold at or in close proximity to the wellhead and delivered down hole to the zone to be fractured adjacent the wellbore. Each stream is supplied to the common wellhead manifold via a separate bank of positive displacement pumps. In such "split-stream" pumping systems, the excessive wear caused by entrained proppant is completely eliminated in the bank of pumps handling the "clean" fluids. Therefore, the extra maintenance is limited to the "dirty" bank of pumps.

An example of a split stream oilfield pumping system is disclosed in U.S. patent application Ser. No. 11/759,776 published under No. 2007/0277982 A1 on Dec. 6, 2007 to Shampine et al. Shampine however makes no provision for the use of recycled treatment fluid. Both of Shampine's fluid streams make use of new treatment fluid not previously recovered from the wellbore. Shampine moreover makes no provision for the use of fluids with a high Reid Vapor Pressure (RVP) that may or may not have been previously recovered from a wellbore.

Recycled treatment fluids demonstrate particular advantages for use in connection with fracturing operations. The recycling of fluid reduces the amount of new fluid required and the amount of fluid to be disposed of when the same fluid is used for a plurality of fracture treatments. Recycled treatment fluids present issues of their own however, which can limit their economic advantages. One of these issues is the Reid Vapor Pressure.

Under the ASTM Method D 323, Reid Vapor Pressure ("RVP") is the absolute vapor pressure exerted by a liquid at 100° F. (37.8° C.). The higher this value, the more volatile the sample and the more readily it will evaporate. Unlike distillation data, RVP provides a single value that reflects the combined effect of the individual vapor pressure of the different petroleum fractions in a fluid sample in accordance with their mole ratios. It is thus possible for two wholly different products to exhibit the same vapor pressure at the same temperature—provided the cumulative pressures exerted by the fractions are the same. RVP plays a role in the prediction of hydrocarbon performance.

Recycled fracturing fluids typically have high RVP due to entrained hydrocarbons ingested when the fluids are pumped into and then recovered from oil and gas bearing formations. However, it is also contemplated that new (i.e. non-recycled) fluids may also have high RVP values. For this reason, the term "recycled" when used in reference to fluids will hereinafter refer generally to fracturing fluids having a high RVP value, regardless of whether the fluids are recycled or new. Some jurisdictions have regulations stipulating that such high RVP fluids for safety and environmental reasons are to be handled in a closed system to reduce or eliminate vaporization of the volatile hydrocarbon fluids, or the escape of the vapors to atmosphere. In the alternative, these high RVP fluids can undergo a re-conditioning process to remove the volatile hydrocarbon fractions as well as other substances.

The need either to employ large scale containment systems or recondition the fracturing fluid prior to reuse, reduces the economic incentive to use them at all. Particularly, if a recycled fluid with a higher than acceptable RVP is to be blended with proppants, the size and expense of the containment system needed to enclose the proppant, the proppant auger and the blender is a significant disadvantage.

Accordingly, there is need for an oil field pumping system that can economically employ un-reconditioned recycled treatment fluids having high RVP without also requiring the use of large scale containment systems which would otherwise be necessary if the recycled fluid had to be blended with proppants.

SUMMARY OF THE INVENTION

It is thus an object of the present invention to provide an oilfield pumping system wherein recycled treatment fluids with a high RVP can be economically and safely reused in pumping operations.

Accordingly, in at least one embodiment, the present invention provides a system wherein at least two streams of fluid are pumped to a common mixing manifold in close proximity to or at the wellhead. The first stream is preferably comprised of a new fluid having a RVP lower than 14 kPa. This fluid can further contain wellbore treatment additives such as wellbore treatment chemicals and/or energizing fluid. This new fluid typically will meet fluid classifications suitable for either open or closed mixing systems. The base fluid for the new fluid can include but is not limited to hydrocarbons, acids, carbon dioxide, nitrogen or water or mixtures thereof.

The second stream comprises a recycled fluid that may or may not have a RVP lower than 14 kPa. This recycled fluid is typically a hydrocarbon fluid that may contain treatment chemicals and/or energizing fluid. In cases where the RVP of the recycled fluid is high (i.e. greater than 14 kPa), the recycled fluid is stored and delivered to the wellhead by a closed recycled fluid system.

The ratio of new fluid to recycled fluid in the mixture delivered to the wellhead will vary depending on the application.

Each fluid is stored in a separate containment device and is delivered to the wellhead by a separate pumping system, the choice of pumps for the systems depending on the particular application at hand. Pump types contemplated for use in connection with the present invention include but are not limited to progressive cavity, centrifugal or positive displacement pumps. Various pump arrangements are contemplated to deliver each stream to the common mixing manifold. These include but are not limited to multiple pumps connected in parallel or in series.

The benefits derived from the present invention will be readily apparent to those skilled in the art. Particularly, in at least one embodiment, the present invention can enable safe and economic recycling of high RVP fluids. The economic savings result from the fact that the recycled fluid does not require costly conditioning and less new fluids are required for the pumping operation. The present invention enables a continuous mixing of proppant and additives by integrating open and closed mixing systems. It is therefore unhindered by the constraints and added expense that would come with a closed system for mixing high RVP fluids and proppants.

Furthermore, in at least one embodiment, the present invention can maintain the high level of safety required in the petroleum production industry as the high RVP recycled fluid remains in a closed system, however the physical size of the closed system is reduced as only the recycled fluid streams need to be enclosed.

BRIEF DESCRIPTION OF THE DRAWINGS

FIG. 1 is a process diagram demonstrating an oilfield pumping system employing high RVP recycled production fluids.

DETAILED DESCRIPTION OF THE INVENTION

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

FIG. 1 shows one embodiment of the present split stream oilfield pumping system 100. In this example, the oilfield pumping system is preferably comprised of a recycled fluid subsystem 200, a new fluid subsystem 300, a wellhead 102, and a common mixing manifold 104. The present oilfield pumping system 100 could be designed to service a single wellhead or multiple wellheads located in the same general vicinity. Furthermore, it is contemplated that the oilfield pumping system 100 could be designed such that it is easily mobile and can be transported from wellhead to wellhead via tractor-trailer, truck, or in any other manner known to the skilled person in the art. It is also contemplated that the pumping system 100 could be integrated into one or more moveable trailers, tractor-trailer combinations, or truck mounts capable of being installed on a truck(s) or other vehicle.

Recycled treatment fluid is preferably recovered from the wellhead 102, and stored in recycled fluid storage tanks 202. However, the recycled fluid may be obtained from any number of sources and may be transported to the well site by any means, including by tanker truck. Entrained proppants and residual dirt and debris are removed from the recycled fluid by filtration, centrifuging, settling or any other method known in the art. Recycled fluid storage tanks 202 are supplied with recycled fluid from wellhead 102 by recovery pump 204 or other means. The pump can be any type of pump suited to the application. Storage tanks 202 are enclosed to provide a contained storage environment for the recycled fluid, which can possibly have a Reid Vapor Pressure ("RVP") of higher than 14 kPa and in such instances is accordingly volatile.

Recycled fluid is pumped from storage tanks 202 by way of recycled fluid supply pump 206, which typically is a centrifugal pump but can be any pump properly chosen by a person skilled in the art. Supply pump 206 provides recycled fluid to high pressure pumps 208, which are typically positive displacement plunger pumps arranged in parallel between supply pump 206 and common mixing manifold 104. However, other pump types and arrangements are contemplated. Because recycled fluid system 200 provides the "clean" stream to manifold 104, it is the more compact of the two fluid subsystems which reduces the size of the containment field for high RVP fluids at substantial cost savings.

New fluid is stored in fluid storage tanks 302 or any other suitable receptacles know to those in the art. New fluid may be manufactured on site or transported to the worksite via typical tanker trucks. Storage tanks 302 can be enclosed or remain open to atmosphere, depending on the type of new fluid employed in the application, which would be chosen by the person skilled in the art. It is contemplated that new fluid could possibly be comprised of (but not limited to) hydrocarbons, acids, carbon dioxide, nitrogen and water.

New fluid is pumped from storage tanks 302 by way of new fluid supply pump 306, which typically is a centrifugal pump but can be any pump properly chosen by a person skilled in the art. Supply pump 306 provides new fluid to blending subsystem 400.

Blending subsystem 400 is preferably comprised of a delivery system 402, such as an auger, to provide proppant from a bulk source to blender mixing chamber 404. New fluid from supply pump 306 is blended with proppant from delivery system 402 at mixing chamber 404, which produces a fracturing fluid with entrained proppant. It is contemplated that other wellbore additives chosen by the skilled person in the art could be added to the fracturing fluid at this time. Blending system 400 could further comprise a chemical additive injector to facilitate the addition of any additives. Assuming the new fluid has a RVP of less than 14 kPa, blending system 400 does not have to be closed.

The density of the fracturing fluid can be determined using a means 406, such as a fluid density meter or a mass flow meter, located downstream from mixing chamber 404, to determine the percentage of proppant entrained in the resultant fracturing fluid. Instrumentation measuring other characteristics of the resultant fracturing fluid is also contemplated at this point in the process. A bypass 408 located between the supply pump 306 and downstream of mixing chamber 404 allows new fluid to be directly pumped from new fluid subsystem 300 to a point downstream of the mixing chamber in situations where proppant is not required, such as when pumping a fluid pad to initiate a fracture in the treatment zone, or there is a need to isolate the mixing chamber.

Pumping system 100 preferably comprises a blending system discharge pump 410 to pump resultant fracturing fluid to high pressure pumps 308, which are typically positive displacement plunger pumps arranged in parallel between discharge pump 410 and common mixing manifold 104. However, other pump types and arrangements are contemplated.

As will be understood by a person skilled in the art, all pumps and piping components that are exposed to abrasive proppant entrained in the fracturing fluid are subject to accelerated wear. Accordingly, maintenance efforts and costs are reduced for the recycled fluid-side pumps, namely the centrifugal pumps and the positive displacement pumps which are not exposed. Furthermore, new fluid supply pump 306 also does not pump proppant-entrained fluid.

The resultant fracturing fluid from high pressure pumps 308 is mixed with the recycled fluid from high pressure pumps 208 in common mixing manifold 104, typically located near the wellhead 102. Blended fluid from the two streams is then delivered to wellhead 102 where it is directed down hole to the wellbore for use in fracturing operations. It is contemplated that common mixing manifold 104 and wellhead 102 can be integral with one another. Alternatively, the two fluid streams from pumps 208 and 308 can be mixed on the low pressure side downstream of mixing manifold 104. The combined fluid streams can then be pumped into a single bank of plunger pumps.

It will be understood that the preferred embodiments mentioned here are merely illustrative of the present invention. Numerous variations in design and use of the present invention may be contemplated in view of the following claims without straying from the intended scope and field of the invention herein disclosed.

What is claimed is:

1. An oilfield pumping system, comprising:

a recycled fluid subsystem enclosed from the atmosphere, the recycled fluid subsystem comprising a recycled fluid source, a recycled fluid supply pump and a high pressure pumping means;

a non-recycled fluid subsystem, the non-recycled fluid subsystem comprising a non-recycled fluid source, a non-recycled fluid supply pump, a proppant blending subsystem, and a non-recycled fluid high pressure pump;

a common mixing manifold; and, a wellhead connection;

wherein the recycled fluid subsystem provides a recycled fluid to the common mixing manifold, the non-recycled fluid subsystem provides a non-recycled fluid to the common mixing manifold, and wherein a mixed fluid is delivered from the common mixing manifold to the wellhead connection;

wherein the recycled fluid in the recycled fluid subsystem has a Reid vapor pressure of 14 kPa or greater.

2. The oilfield pumping system of claim 1, wherein the blending subsystem comprises a proppant delivery system, a blender mixing chamber and a discharge pump.

3. The oilfield pumping system of claim 2, wherein the discharge pump is a progressive cavity pump, a centrifugal pump, or a positive displacement pump.

4. The oilfield pumping system of claim 2, wherein the blending system is further comprised of a bypass between the non-recycled fluid system and the discharge pump.

5. The oilfield pumping system of claim 4, wherein the blending subsystem further comprises a means for measuring fluid density, the means being located downstream from the blender mixing chamber.

6. The oilfield pumping system of claim 5, wherein the oilfield pumping system is incorporated into tractor-trailer combination or truck mount.

7. The oilfield pumping system of claim 1, wherein the common mixing manifold is proximate to or integral with the wellhead connection.

8. The oilfield pumping system of claim 1, wherein the recycled fluid source is a wellhead.

9. The oilfield pumping system of claim 1, wherein the recycled fluid source is a storage tank.

10. The oilfield pumping system of claim 1, wherein the non-recycled fluid source is a storage tank.

11. The oilfield pumping system of claim 1, wherein the recycled fluid supply pump is a progressive cavity pump, a centrifugal pump, or a positive displacement pump.

12. The oilfield pumping system of claim 1, wherein the non-recycled fluid supply pump is a progressive cavity pump, a centrifugal pump, or a positive displacement pump.

13. The oilfield pumping system of claim 1, wherein the proppant blending subsystem further comprises a chemical additive injector.

14. A method for treating a wellbore with an oilfield pumping system, the system comprising a non-recycled fluid subsystem, a recycled fluid subsystem enclosed from the atmosphere, a common mixing manifold, and a wellhead connection, wherein:

the non-recycled fluid subsystem provides a non-recycled fluid;

the recycled fluid subsystem provides a recycled fluid, wherein the recycled fluid in the recycled fluid subsystem has a Reid vapor pressure of greater than 14 kPa;

the non-recycled fluid is mixed with the recycled fluid in the common mixing manifold to provide a mixed fluid; and the mixed fluid is delivered to the wellhead connection, wherein the wellhead connection is in fluid communication with the wellbore.

15. The method of claim 14, wherein the common mixing manifold is integral with the wellhead connection.

16. The method of claim 14, wherein the non-recycled fluid comprises a hydrocarbon, an acid, carbon dioxide, nitrogen or water or mixtures thereof.

17. The method of claim 16, wherein the non-recycled fluid subsystem further comprises a blending subsystem, the blending subsystem comprising means for introducing wellbore treatment additives into the non-recycled fluid subsystem.

18. The method of claim 17, wherein the wellbore treatment additives are propping agents.

19. The method of claim 17, wherein the wellbore treatment additives are wellbore treatment chemicals.

* * * * *